US010622742B2

(12) United States Patent
Chen

(10) Patent No.: US 10,622,742 B2
(45) Date of Patent: Apr. 14, 2020

(54) EARPHONE SOCKET, MOUNTING STRUCTURE AND MOBILE TERMINAL

(71) Applicant: GUANGDONG OPPO MOBILE TELECOMMUNICATIONS CORP., LTD., Dongguan, Guangdong (CN)

(72) Inventor: Jia Chen, Guangdong (CN)

(73) Assignee: GUANGDONG OPPO MOBILE TELECOMMUNICATIONS CORP., LTD., Dongguan, Guangdong (CN)

( * ) Notice: Subject to any disclaimer, the term of this patent is extended or adjusted under 35 U.S.C. 154(b) by 0 days.

(21) Appl. No.: 16/152,465

(22) Filed: Oct. 5, 2018

(65) Prior Publication Data

US 2019/0140380 A1 May 9, 2019

(30) Foreign Application Priority Data

Nov. 9, 2017 (CN) ..... 2017 1 1096858
Nov. 9, 2017 (CN) ..... 2017 2 1485374 U

(51) Int. Cl.
*H01R 24/58* (2011.01)
*H01R 13/11* (2006.01)
(Continued)

(52) U.S. Cl.
CPC ..... *H01R 13/111* (2013.01); *H01R 12/714* (2013.01); *H01R 12/718* (2013.01);
(Continued)

(58) Field of Classification Search
CPC ..... H01R 24/58; H01R 24/60; H01R 12/718; H01R 12/714
(Continued)

(56) References Cited

U.S. PATENT DOCUMENTS 4,037,913 A * 7/1977 Deitch ..... H01R 24/58 439/668
4,364,625 A 12/1982 Baker et al.
(Continued)

FOREIGN PATENT DOCUMENTS

CN 201781101 U 3/2011
CN 102487407 A 6/2012
(Continued)

OTHER PUBLICATIONS

International search report for Application No. PCT/CN2018/114083, dated Jan. 30, 2019 (11 pages).
(Continued)

*Primary Examiner* — Hien D Vu
(74) *Attorney, Agent, or Firm* — Ladas & Parry LLP

(57) ABSTRACT

The present disclosure relates to an earphone socket, a mounting structure and a mobile terminal. The earphone socket includes: a support base; a functional assembly including a microphone resilient component, a right channel resilient component and a left channel resilient component which are fixed on the support base; and an earthing resilient component fixed on the support base. The microphone resilient component includes a first arc-shaped sleeve. The right channel resilient component includes a second arc-shaped sleeve. The left channel resilient component includes a circular sleeve and a first resilient contact piece coupled to the circular sleeve. The first arc-shaped sleeve, the second arc-shaped sleeve, and the circular sleeve are arranged to define a plughole configured to mate with the earphone plug. The first resilient contact piece is configured to press the earphone plug.

20 Claims, 9 Drawing Sheets

(51) Int. Cl.

| | |
|---|---|
| ***H01R 12/71*** | (2011.01) |
| ***H01R 13/652*** | (2006.01) |
| ***H01R 13/46*** | (2006.01) |
| ***H04R 1/10*** | (2006.01) |
| *H01R 107/00* | (2006.01) |

(52) U.S. Cl.
CPC ..... *H01R 13/46* (2013.01); *H01R 13/652* (2013.01); *H01R 24/58* (2013.01); *H04R 1/1008* (2013.01); *H01R 2107/00* (2013.01); *H01R 2201/16* (2013.01)

(58) Field of Classification Search
USPC ..... 439/688, 669, 676, 682
See application file for complete search history.

(56) References Cited

U.S. PATENT DOCUMENTS

| | | | | |
|---|---|---|---|---|
| 4,598,970 | A * | 7/1986 | Takihara | H01R 24/58 439/668 |
| 5,338,215 | A * | 8/1994 | Lee | H01R 13/703 200/51.1 |
| 7,901,251 | B1 * | 3/2011 | Chen | H01R 24/58 439/668 |
| 7,988,488 | B2 | 8/2011 | Lim et al. | |
| 7,988,498 | B1 * | 8/2011 | Lim | H01R 24/58 439/668 |
| 8,215,989 | B2 * | 7/2012 | Tamm | H01R 13/6594 381/1 |
| 8,678,863 | B2 * | 3/2014 | Nagata | H01R 13/5213 439/606 |
| 2017/0201842 | A1 | 7/2017 | Liu et al. | |

FOREIGN PATENT DOCUMENTS

| | | | |
|---|---|---|---|
| CN | 102487470 | A | 6/2012 |
| CN | 202678576 | U | 6/2012 |
| CN | 203826651 | U | 9/2014 |
| CN | 203826651 | U | 10/2014 |
| CN | 105098448 | A | 11/2015 |
| CN | 207588021 | U | 6/2018 |
| CN | 207588021 | U | 7/2018 |
| EP | 3142195 | A1 | 3/2017 |

OTHER PUBLICATIONS

European search report for Application No. EP18204884.3, dated Mar. 14, 2019 (7 pages).
CN 207588021U (Guangdong OPPO Mobile Telecommunications Corp Ltd) Jul. 6, 2018(Jul. 6, 2018) claims 1-16.
CN 102487470A (Korea Air Electronics Co Ltd) Jun. 6, 2012(Jun. 6, 2010) paragraphs 0021-0052 in the description, figs. 1-6.
CN 102487470A (Korea Air Electronics Co Ltd) Jun. 6, 2012(Jun. 6, 2012) paragraphs 0021-0052 in the description, figs. 1-6.
CN 105098448A (Qingdao Hisense Mobile Comm) Nov. 25, 2015(Nov. 25, 2015) paragraphs 0034-0061 in the description, figs. 2-7.
CN 203826651U (Hangzhou Naxiong Technology Co Ltd) Sep. 10, 2014(Sep. 10, 2014) the whole document.
First Office Action from China patent in a counterpart Chinese patent Application 201711096858.2, dated Apr 23, 2019 (5 pages).
Secend Office Action from China patent office in a counterpart Chinese patent Application 201711096858.2, dated Jul. 2, 2019 (4 pages).

* cited by examiner

EARPHONE SOCKET, MOUNTING STRUCTURE AND MOBILE TERMINAL

CROSS-REFERENCE TO RELATED APPLICATIONS

This application claims priorities to Chinese Patent Application Nos. 201711096858.2 and 201721485374.2, both filed on Nov. 9, 2017, the contents of which are herein incorporated by reference in their entireties.

TECHNICAL FIELD

The present disclosure relates to the field of mobile terminals, and in particular, to an earphone socket, a mounting structure, and a mobile terminal including the earphone socket.

BACKGROUND

When an earphone socket is installed in a mobile terminal such as a mobile phone, the mobile terminal must have enough housing space to accommodate the earphone socket. However, in related art, the housing space of the mobile terminal for the earphone socket is large, which eventually causes the entire mobile terminal to be bulky.

BRIEF DESCRIPTION OF THE DRAWINGS

In order to make the technical solution described in the embodiments of the present disclosure more clearly, the drawings used for the description of the embodiments will be briefly described. Apparently, the drawings described below are only for illustration, but not for limitation. It should be understood that, one skilled in the art may acquire other drawings based on these drawings, without making any inventive work.

DETAILED DESCRIPTION

Figure 1:
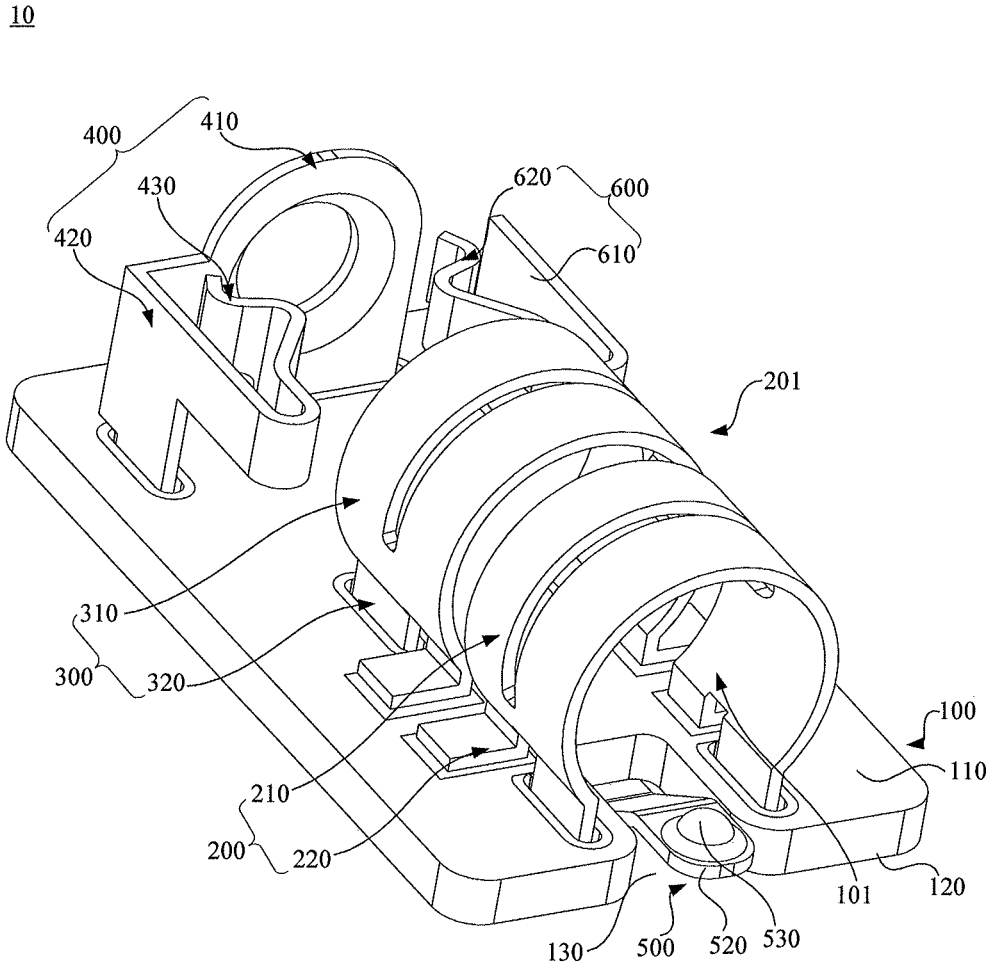
FIG. 1 is an assembled, structural schematic view of an earphone socket according to an embodiment.

In order to facilitate the understanding of the present disclosure, the present disclosure will be described more fully hereinafter with reference to the accompanying drawings. Preferred embodiments of the present disclosure are given in the drawings. However, the present disclosure may be embodied in many different forms and is not limited to the embodiments described herein. Rather, these embodiments are provided so that the present disclosure will be more fully understood.

It should be noted that, when an element is referred to as being "fixed" to the other element, it may be directly on the other element or a further element may be presented therebetween. When an element is considered to be "mounted", "connected", "coupled" to the other element, it can be directly connected to the other element or a further element may be presented therebetween. The terms "inner", "outer", "left", "right", and the like, as used herein, are for the purpose of illustration and are not intended to be the only implementation means.

Figure 14:
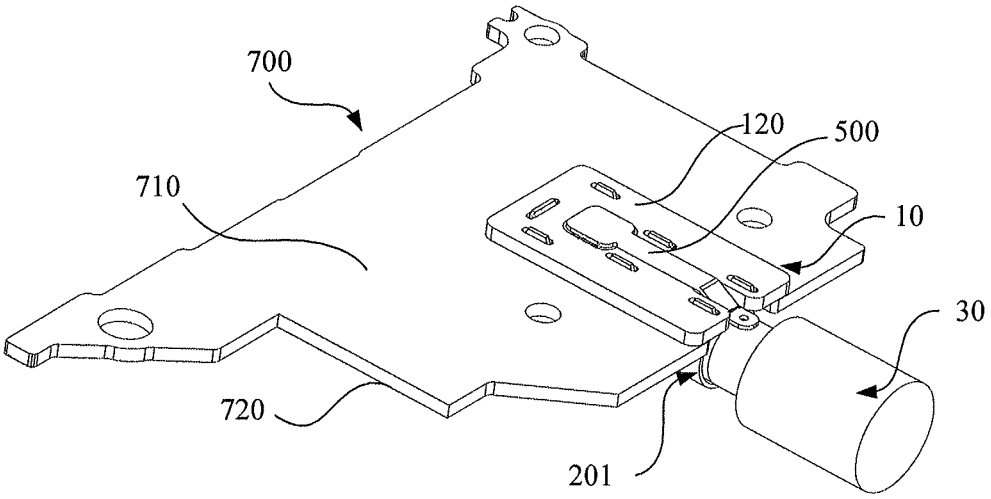
FIG. 14 is an assembled schematic view of the mounting structure of FIG. 13.
Figure 15:
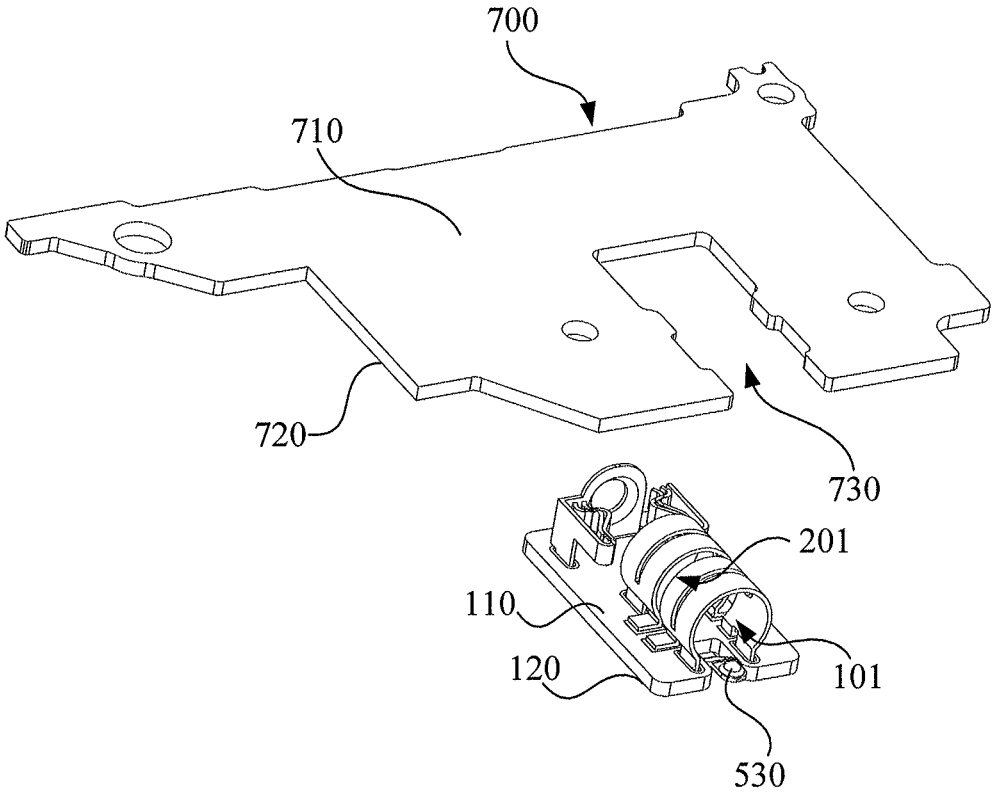
FIG. 15 is an exploded schematic view of a mounting structure according to another embodiment.
Figure 16:
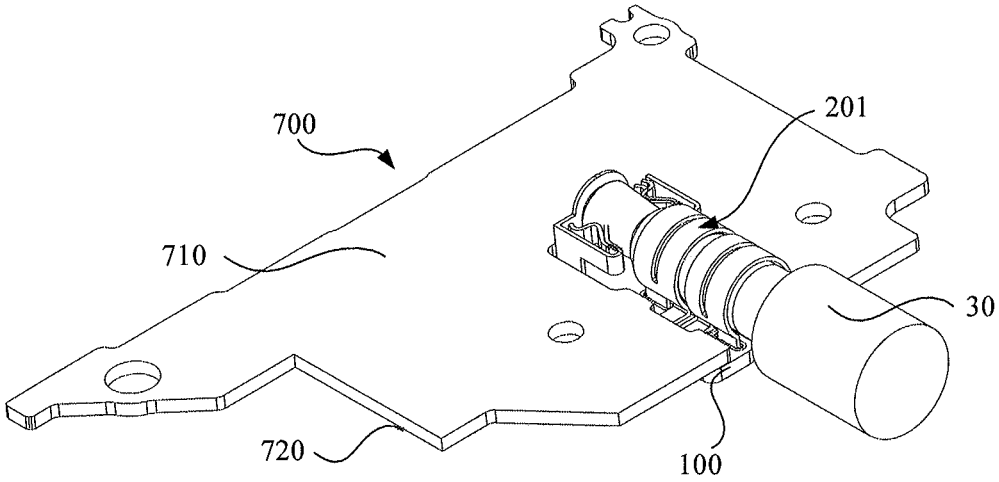
FIG. 16 is an assembled schematic view of the mounting structure of FIG. 15.

Referring to FIG. 1, an earphone socket 10 for mating with an earphone plug 30 (referring to FIG. 14) is shown. The earphone socket 10 includes a support base 100, a functional assembly 201, and an earthing resilient component 500. The functional assembly 201 includes a microphone resilient component 200, a right channel resilient component 300, and a left channel resilient component 400. The support base 100 may be a circuit board, and the support base 100 includes a first mounting surface (i.e., upper surface) 110 and a second mounting surface (i.e., lower surface) 120 opposite to the first mounting surface 110. The microphone resilient component 200, the right channel resilient component 300, and the left channel resilient component 400 are fixed on the first mounting surface 110. The earthing resilient component 500 is fixed on the second mounting surface 120.

The microphone resilient component 200 includes a first arc-shaped sleeve 210 and a first assembling part 220. The first arc-shaped sleeve 210 defines a cylindrical cavity 214 therein, and the side wall enclosing the cylindrical cavity 214 defines a notch 215 (referring to FIGS. 3-4). The first arc-shaped sleeve 210 is configured to mate with the earphone plug 30, and is configured to press the earphone plug 30. The first assembling part 220 is positioned at two ends of the first arc-shaped sleeve 210, and the first assembling part 220 is coupled to the support base 100. The right channel resilient component 300 has a structure substantially similar to the microphone resilient component 200, and the right channel resilient component 300 includes a second arc-shaped sleeve 310 and a second assembling part 320. The second arc-shaped sleeve 310 defines a cylindrical cavity 314 therein, and the side wall enclosing the cylindrical cavity 314 defines a notch 315 (referring to FIGS. 5-6). The second arc-shaped sleeve 310 is configured to mate with the earphone plug 30, and is configured to press the earphone plug 30. The second assembling part 320 is positioned at two ends of the second arc-shaped sleeve 310, and the second assembling part 320 is coupled to the support base 100. The left channel resilient component 400 includes a circular sleeve 410, a third assembling part 420, and a first resilient contact piece 430. The circular sleeve 410 defines an integral cylindrical cavity with two opposite openings. The third assembling part 420 is positioned on the circular sleeve 410, and the third assembling part 420 is coupled to the support base 100. The circular sleeve 410 is configured to mate with the earphone plug 30, and the first resilient contact piece 430 is configured to press the earphone plug 30. That is to say, the first arc-shaped sleeve 210, the second arc-shaped sleeve 310 and the circular sleeve 410 are arranged to define a plughole 101, and the earphone plug 30 mates with the plughole 101.

The microphone resilient component 200, the right channel resilient component 300, the left channel resilient component 400, and the earthing resilient component 500 are all provided in the form of resilient trips and are all mounted on the support base 100. Such resilient trip has a thin thickness and has a certain mechanical strength. Therefore, the volume of the entire earphone socket 10 is reduced in this way, the size of the headphone jack 10 is reduced in the thickness direction of the support base 100 (i.e., the height dimension of the headphone jack 10 is reduced), and the installation space required for the earphone socket 10 is reduced. Also, the material required for the microphone resilient component 200, the right channel resilient component 300, the left channel resilient component 400 and the earthing resilient component 500 is reduced, and the production cost and material cost of the earphone socket 10 is hereby reduced. When the earphone socket 10 is installed on a mobile terminal such as a mobile phone, the total thickness of the mobile terminal can be effectively reduced, which is in line with the trend of thinning the mobile terminal.

In some embodiments, the microphone resilient component 200, the right channel resilient component 300, the left channel resilient component 400, and the earthing resilient component 500 may each be made of a stainless steel material, and the thickness of the four resilient components may range from 0.15 mm to 0.30 mm. In other embodiments, the microphone resilient component 200, the right channel resilient component 300, the left channel resilient component 400, and the earthing resilient component 500 can also be made of material such as phosphor bronze, beryllium copper, white copper (i.e., copper-nickel-zinc alloy), or red copper, etc., and can also reduce the height dimension, volume and production cost, etc. of the earphone socket 10.

In some embodiments, the thickness of the support base 100 ranges from 0.6 mm to 2 mm. For example, the support base 100 may be 0.6 mm, 1 mm, 2 mm and so on according to actual conditions. On the basis of ensuring mechanical strength, the thinner the thickness of the support base 100, the lower the height dimension and volume of the entire earphone socket 10. This further reduces the installation space required for the earphone socket 10.

Figure 2:
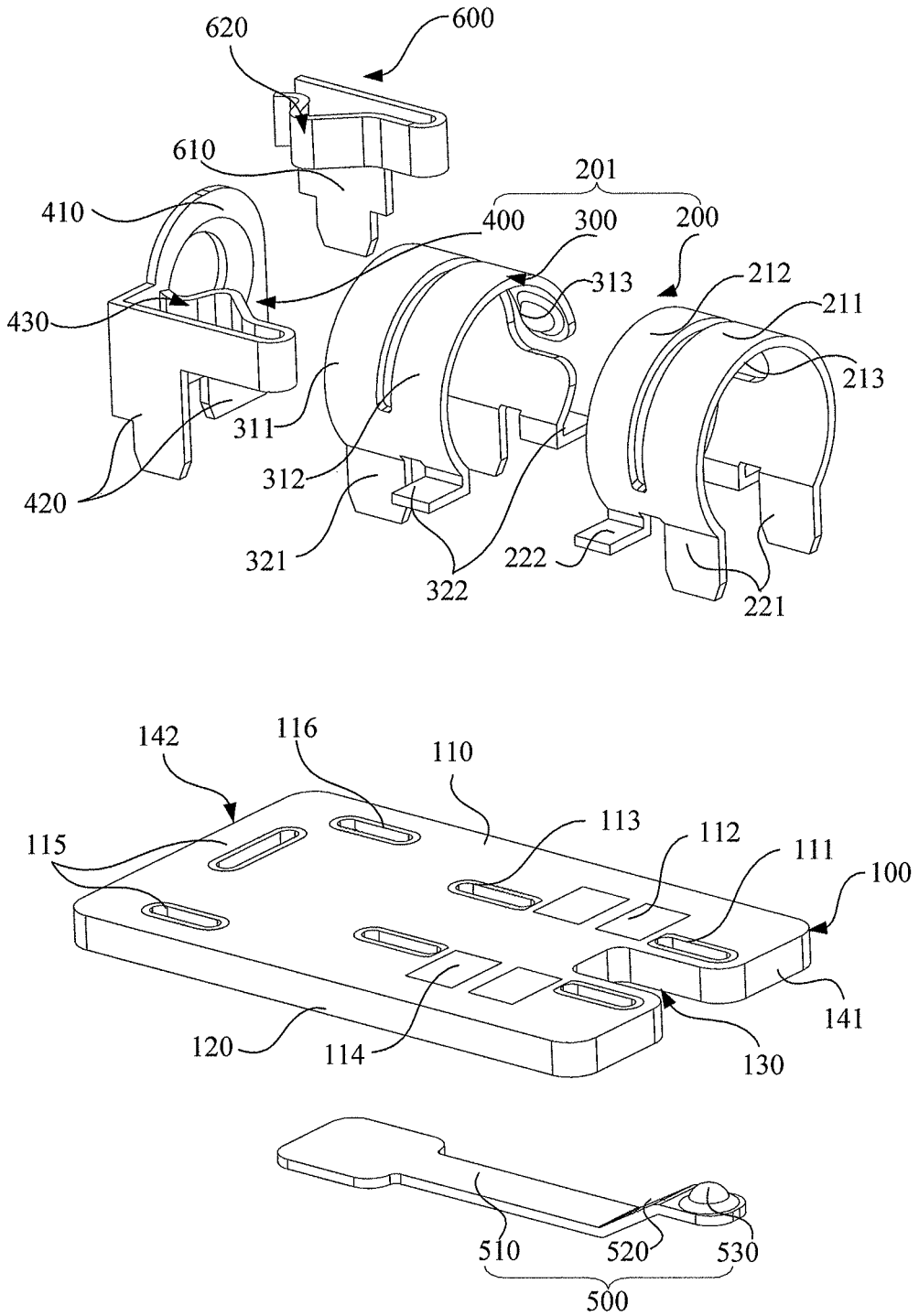
FIG. 2 is an exploded, structural schematic view of an earphone socket according to an embodiment.

Referring to FIGS. 1 and 2, in some embodiments, the microphone resilient component 200 is located at an end 141 of the support base 100, and the microphone resilient component 200 is used for receiving sound waves and converting the sound waves into sound electrical signals. The left channel resilient component 400 is located at the other end 142 of the support base 100, and the left channel resilient component 400 is used for converting a sound signal of a particular frequency (e.g., a low frequency signal). The right channel resilient component 300 is located between the microphone resilient component 200 and the left channel resilient component 400, and the right channel resilient component 300 is also used for converting a sound signal of a particular frequency (e.g., a high frequency signal). In short, the microphone resilient component 200 and the left channel resilient component 400 are located at two ends of the support base 100 respectively, and the right channel resilient component 300 is located in the middle of the support base 100. Of course, the relative mounting positions of the microphone resilient component 200, the left channel resilient component 400, and the right channel resilient component 300 on the support base 100 may also be changed. The left channel resilient component 400 and the microphone resilient component 200 may also be located in the middle of the support base 100.

Figure 3:
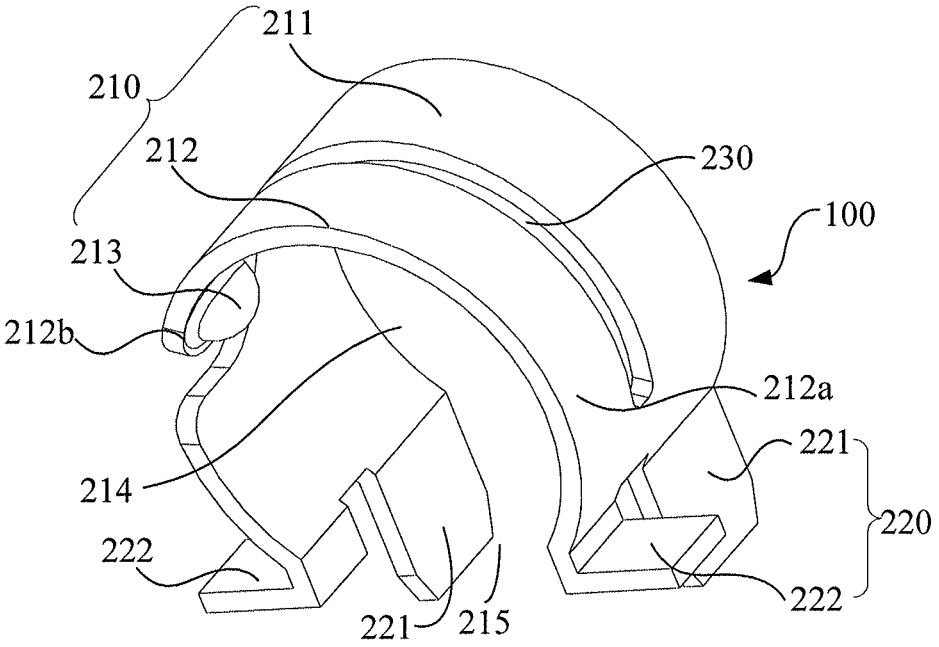
FIG. 3 is an isometric, structural schematic view of a microphone resilient component shown in FIG. 2.
Figure 4:
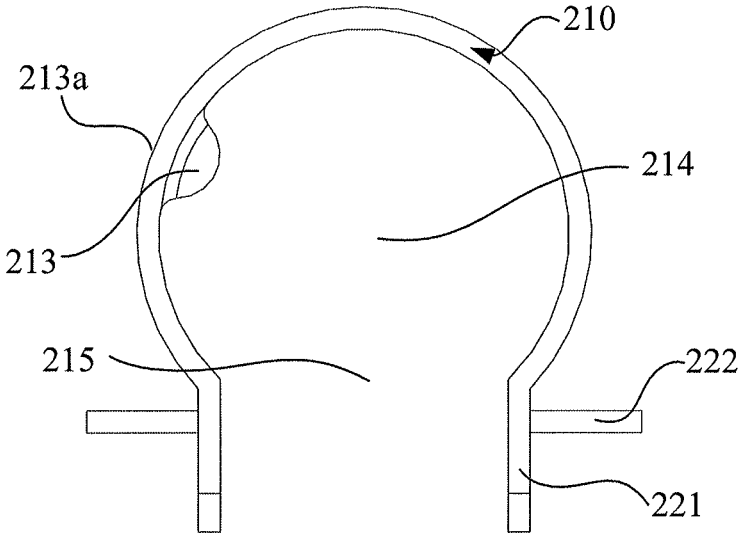
FIG. 4 is a front schematic view of the microphone resilient component of FIG. 3.

Referring to FIGS. 2 to 4, in some embodiments, the first arc-shaped sleeve 210 includes a first arc-shaped mating body 211, a first arc-shaped resilient piece 212, and a first protruding part 213. When the earphone plug 30 is inserted into the plughole 101 of the earphone socket 10, the first arc-shaped mating body 211 mates with the earphone plug 30 and hereby positions the earphone plug 30. The first arc-shaped resilient piece 212 is similar to the first arc-shaped sleeve 210 in shape. A first end 212*a* of the first arc-shaped resilient piece 212 is coupled to one end of the first arc-shaped mating body 211, a second end 212*b* of the first arc-shaped resilient piece 212 is a free end, and the second end 212*b* corresponds to the other end of the first arc-shaped mating body 211 (the second end 212*b* is not connected to the first arc-shaped mating body 211). The first arc-shaped mating body 211 and the first arc-shaped resilient piece 212 are spaced apart from each other by a first gap 230. The first gap 230 runs through the inner surface and the outer surface of the first arc-shaped sleeve 210, and the first gap 230 extends circumferentially along the first arc-shaped sleeve 210. Due to the action of the first gap 230, the first arc-shaped resilient piece 212 can swing freely to form a pressing force to the earphone plug 30.

The first protruding part 213 is located at a second end 212*b* of the first arc-shaped resilient piece 212, and the first protruding part 213 protrudes a certain distance from an inner surface of the first arc-shaped resilient piece 212. The shape of the first protruding part 213 may be a taper or the like. When the earphone plug 30 mates with the first arc-shaped sleeve 210, the first protruding part 213 abuts against the earphone plug 30 due to the resilient action of the first arc-shaped resilient piece 212, thereby functioning to transmit sound signals. The first protruding part 213 may further define a first through hole 213*a*, and the first through hole 213*a* is used for electrically connecting with an external line.

In some embodiments, the first assembling part 220 includes a plurality of first inserting pieces 221 and a plurality of first supporting lugs 222. The first inserting pieces 221 are coupled to two ends of the first arc-shaped mating body 211. One of the first supporting lugs 222 is coupled to the first end 212*a* of the first arc-shaped resilient piece 212, the other one of the first supporting lugs 222 is coupled to the first arc-shaped mating body 211 and corresponds to the second end 212*b* of the first arc-shaped resilient piece 212 such that the mentioned two first supporting lugs 222 and the second end 212*b* may lie in a same plane (e.g., the two centers of the mentioned two first supporting lugs 222 and the two center of the second end 212*b* may lie in a same plane). In other words, one first inserting piece 221 and one first supporting lug 222 are coupled to one end of the first arc-shaped sleeve 210, and another one first inserting piece 221 and another one first supporting lug 222 are coupled to another one end of the first arc-shaped sleeve 210. In some embodiments, the first inserting piece 221 can be vertically disposed, and the first supporting lug 222 can be horizontally disposed. At the same end of the first arc-shaped sleeve 210, the first inserting piece 221 is located beside the first supporting lug 222, and the first inserting piece 221 and the first supporting lug 222 can be perpendicular to each other.

The support base 100 defines a plurality of first mounting holes 111 and a plurality of first recessed grooves 112. The number of the first mounting holes 111 may be same with the number of the first inserting piece 221, and the number of the first recessed grooves 112 may be same with the number of the first supporting lug 222. In one embodiment, the number of the first mounting holes 111 is two, and the number of the first recessed grooves 112 is two. In other embodiments, the number of the first mounting holes 111 may be three, four and so on, and the number of the first recessed grooves 112 may be three, four and so on. The first inserting piece 221 is inserted into the first mounting hole 111, and the first supporting lug 222 is fixed in the first recessed groove 112. Therefore, the connection between the microphone resilient component 200 and the support base 100 is realized.

Figure 5:
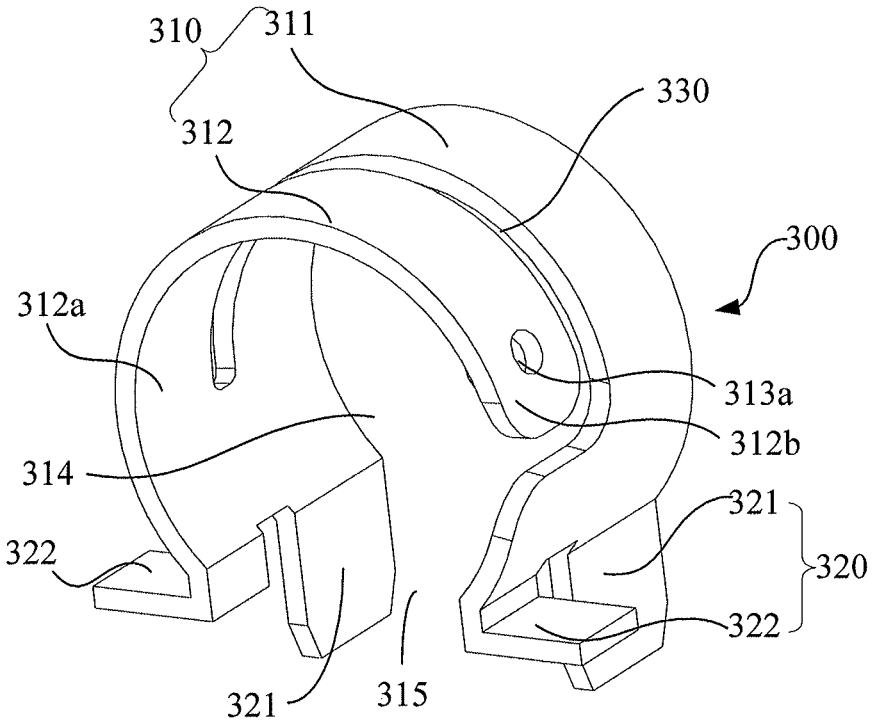
FIG. 5 is an isometric, structural schematic view of a right channel resilient component shown in FIG. 2.
Figure 6:
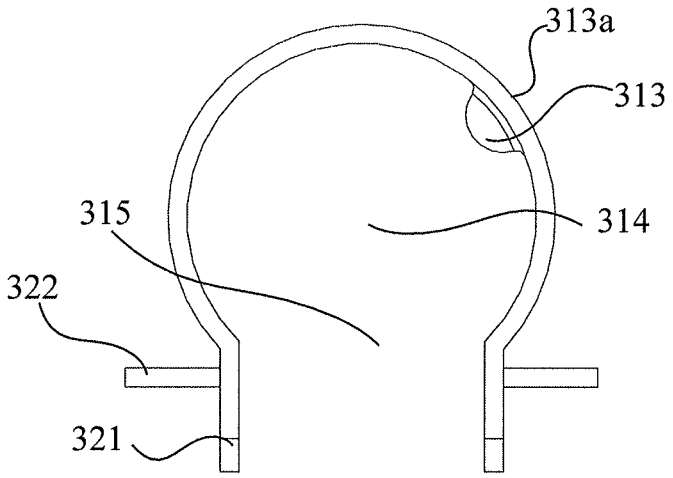
FIG. 6 is a front schematic view of the right channel resilient component of FIG. 5.

Referring to FIGS. 2, 5 and 6, in some embodiments, the second arc-shaped sleeve 310 includes a second arc-shaped mating body 311, a second arc-shaped resilient piece 312, and a second protruding part 313. When the earphone plug 30 is inserted into the plughole 101 of the earphone socket 10, the second arc-shaped mating body 311 mates with the earphone plug 30, and hereby positions the earphone plug 30. The second arc-shaped resilient piece 312 is similar to the second arc-shaped sleeve 310 in shape. A first end 312*a* of the second arc-shaped resilient piece 312 is coupled to one end of the second arc-shaped mating body 311, a second end 312*b* of the second arc-shaped resilient piece 312 is a free end, and the second end 312*b* corresponds to the other end of the second arc-shaped mating body 311 (the second end 312*b* is not connected to the second arc-shaped mating body 311). The second arc-shaped mating body 311 and the second arc-shaped resilient piece 312 are separated by a second gap 330. The second gap 330 runs through the inner surface and the outer surface of the second arc-shaped sleeve 310, and the second gap 330 extends circumferentially along the second arc-shaped sleeve 310. Due to the action of the second gap 330, the second arc-shaped resilient piece 312 can swing freely, so that a pressing force to the earphone plug 30 can be formed.

The second protruding part 313 is located at a second end 312*b* of the second arc-shaped resilient piece 312, and the second protruding part 313 protrudes a certain distance from an inner surface of the second arc-shaped resilient piece 312. The second protruding part 313 may be a taper or the like. When the earphone plug 30 mates with the second arc-shaped sleeve 310, the second protruding part 313 abuts against the earphone plug 30 due to the resilient action of the second arc-shaped resilient piece 312, thereby functioning to transmit sound signals. The second protruding part 313 may further define a second through hole 313*a*, and the second through hole 313*a* is used for electrically connecting with an external line.

In some embodiments, the second assembling part 320 includes a plurality of second inserting pieces 321 and a plurality of second supporting lugs 322. The second inserting pieces 321 are coupled to two ends of the second arc-shaped mating body 311. One of the second supporting lugs 322 is coupled to the first end 312*a* of the second arc-shaped resilient piece 312, the other one of the second supporting lugs 322 is coupled to the second arc-shaped mating body 311 and corresponds to the second end 312*b* of the second arc-shaped resilient piece 312 such that the mentioned two second supporting lugs 322 and the second end 312*b* may lie in a same plane. In other words, one second inserting piece 321 and one second supporting lug 322 are coupled to one end of the second arc-shaped sleeve 310, and another one second inserting piece 321 and another one second supporting lug 322 are coupled to another one end of the second arc-shaped sleeve 310. In some embodiments, the second inserting piece 321 can be vertically disposed, the second supporting lug 322 can be horizontally disposed. At the same end of the second arc-shaped sleeve 310, the second inserting piece 321 is located beside the second supporting lug 322, and the second inserting piece 321 and the second supporting lug 322 can be perpendicular to each other.

The support base 100 defines a plurality of second mounting holes 113 and a plurality of second recessed grooves 114. The number of the second mounting hole 113 may be same with the number of the second inserting piece 321, and the number of the second recessed groove 114 may be same with the number of the second supporting lug 322. In one embodiment, the number of the second mounting hole 113 is two, and the number of the second recessed groove 114 is two. The two second inserting pieces 321 are inserted into the second mounting holes 113, and the two second supporting lugs 322 are fixed in the second recessed grooves 114. Therefore, the connection between the right channel resilient component 300 and the support base 100 is realized. In other embodiments, the number of the second mounting hole 113 may be three, four and so on, and the number of the second recessed groove 114 may be three, four and so on.

Referring to FIG. 2, in some embodiments, the first mounting holes 111, the second mounting holes 113, the first recessed grooves 112, and the second recessed grooves 114 are arranged in two rows on the support base 100. On the same row, the first recessed groove 112 and the second recessed groove 114 are arranged adjacently (in the middle of the row), and the first mounting hole 111 and the second mounting hole 113 are located at both ends of the row. Therefore, when the first arc-shaped resilient piece 212 and the second arc-shaped resilient piece 312 are installed on the support base 100, the first arc-shaped resilient piece 212 and the second arc-shaped resilient piece 312 are arranged adjacently. Of course, when the first arc-shaped resilient piece 212 is adjacent to the second arc-shaped mating body 311, the positional relationship of the first mounting hole 111, the second mounting hole 113, the first recessed groove 112 and the second recessed groove 114 on the row will change accordingly.

Figure 7:
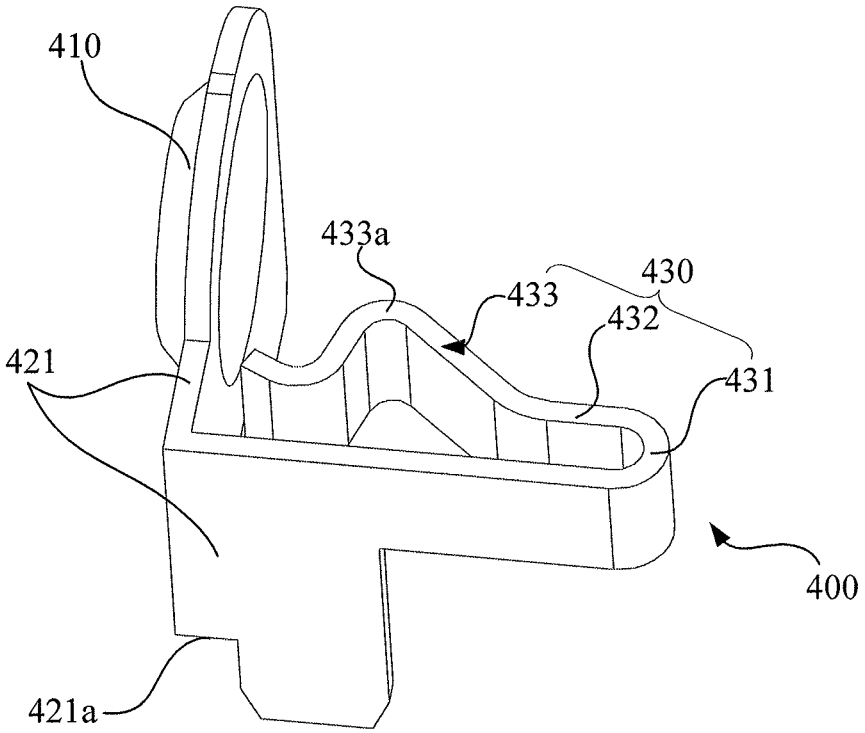
FIG. 7 is an isometric, structural schematic view of a left channel resilient component shown in FIG. 2.
Figure 8:
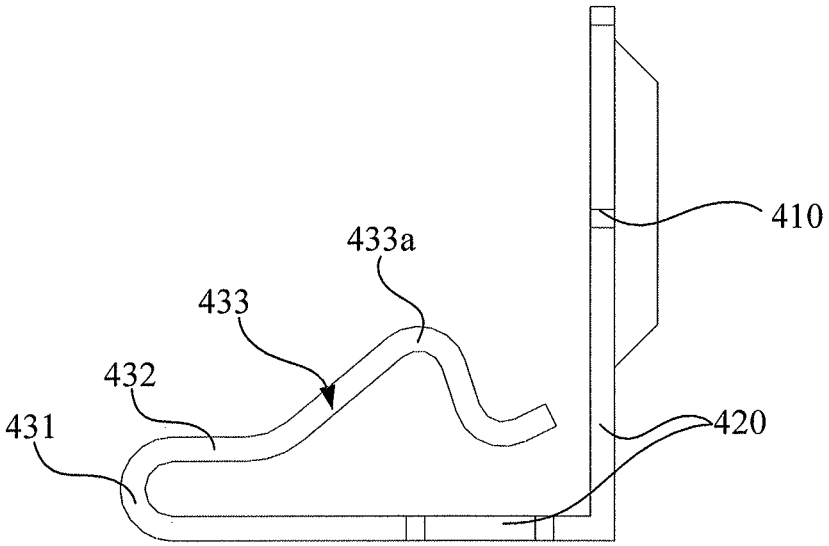
FIG. 8 is a bottom schematic view of the left channel resilient component of FIG. 7.

Referring to FIGS. 2, 7, and 8, in some embodiments, the first resilient contact piece 430 is divided into three segments, that is, the first resilient contact piece 430 includes a first arc segment 431, a first linear segment 432, and a first curved segment 433 which are sequentially connected. The first arc segment 431 is coupled to the third assembling part 420, and the first linear segment 432 is coupled to the first arc segment 431. One end of the first curved segment 433 is coupled to the first linear segment 432, and the other end of the first curved segment 433 is a free end. The first curved segment 433 may be curved in a wave shape, and the first curved segment 433 is bent and provided with a protrusion 433*a* (for example, the protrusion 433*a* is a peak of the wavy first curved segment 433). The protrusion 433*a* is used to abut against the earphone plug 30, thereby achieving signal communication between the left channel resilient component 400 and the earphone plug 30.

The third assembling part 420 includes two third inserting pieces 421, and the two third inserting pieces 421 are coupled to the circular sleeve 410. For example, the two third inserting pieces 421 may be perpendicular to each other, and the first resilient contact piece 430 is coupled to one of the third inserting pieces 421. The first resilient contact piece 430 is located in a space surrounded by the third inserting pieces 421 and the circular sleeve 410 to ensure that the first resilient contact piece 430 can abut against the earphone plug 30. Each of the two third inserting pieces 421 has a first step surface 421*a*. The support base 100 defines two third mounting holes 115. The third inserting piece 421 is inserted into the third mounting hole 115, and the first step surface 421*a* is in close contact with the first mounting surface 110. Therefore, the fixed connection between the left channel resilient component 400 and the support base 100 is achieved.

Figure 11:
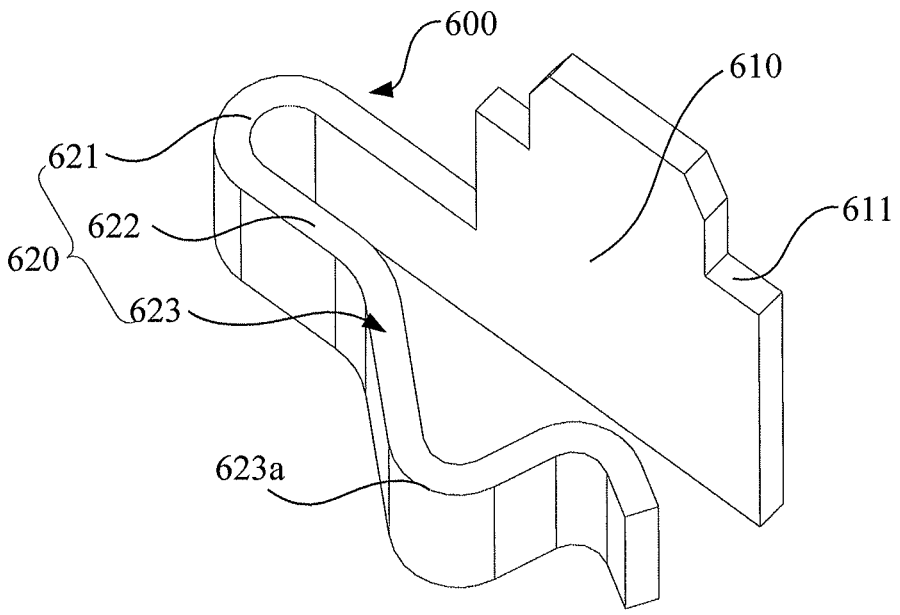
FIG. 11 is an isometric, structural schematic view of a detection resilient component shown in FIG. 2.
Figure 12:
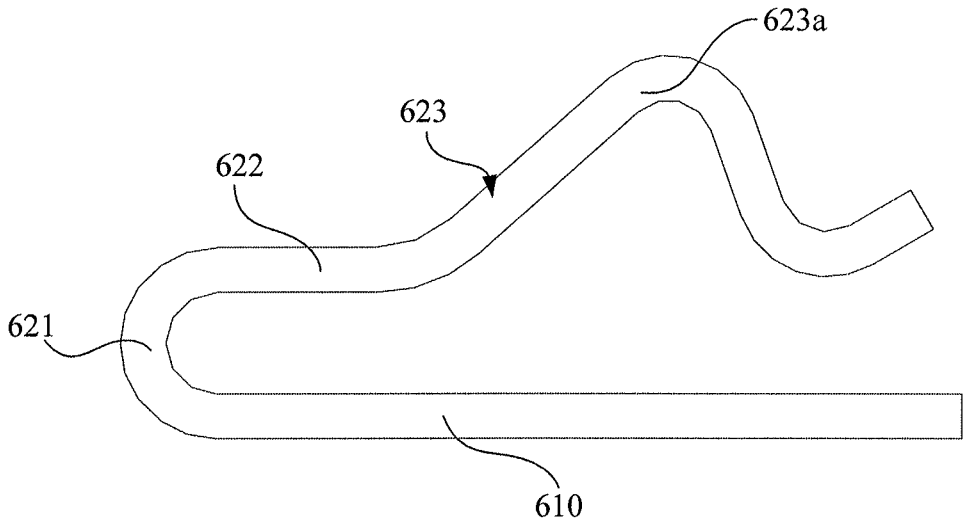
FIG. 12 is a top schematic view of the detection resilient component of FIG. 11.
Figure 13:
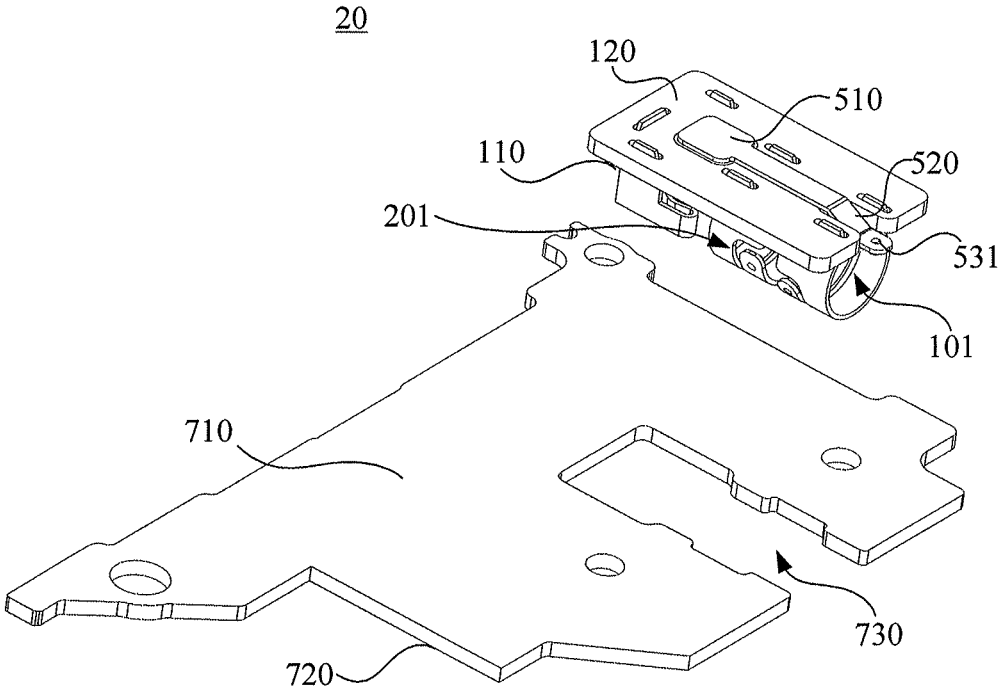
FIG. 13 is an exploded schematic view of a mounting structure according to one embodiment.

Referring to FIGS. 2, 11 and 12, in some embodiments, the earphone socket 10 may further includes a detection resilient component 600, and the detection resilient component 600 is used for detecting whether the earphone plug 30 and the earphone socket 10 are well fitted. The detection resilient component 600 includes a fourth inserting piece 610 and a second resilient contact piece 620, and the structure of the second resilient contact piece 620 is similar to the first resilient contact piece 430.

The second resilient contact piece 620 is divided into three segments; that is, the second resilient contact piece 620 includes a second arc segment 621, a second linear segment 622 and a second curved segment 623 which are sequentially connected. The second arc segment 621 is coupled to the fourth inserting piece 610, and the second linear segment 622 is coupled to the second arc segment 621. One end of the second curved segment 623 is coupled to the second linear segment 622, and the other end of the second curved segment 623 is a free end. The second curved segment 623 may be curved in a wave shape, and the second curved segment 623 is bent and provided with a protrusion 623*a* (for example, the protrusion 623*a* is a peak of the wavy second curved segment 623). The protrusion 623*a* is used to abut against the earphone plug 30, thereby achieving signal communication between the detection resilient component 600 and the earphone plug 30. When the earphone plug 30 and the earphone socket 10 are poorly engaged, the protrusion 623*a* on the second curved segment 623 and the earphone plug 30 are not in contact with each other, and an alert signal can be issued to re-adjust the cooperation of the earphone plug 30 and the earphone socket 10.

The number of the fourth inserting piece 610 is one, and the fourth inserting piece 610 has a second step surface 611. The support base 100 defines a fourth mounting hole 116. The fourth inserting piece 610 is inserted into the fourth mounting hole 116, and the second step surface 611 is in close contact with the first mounting surface 110. Therefore, the connection between the detection resilient component 600 and the support base 100 is realized.

When the detection resilient component 600 and the left channel resilient component 400 are simultaneously mounted on the support base 100, the two are disposed adjacent to each other; that is, both are located at the same end of the support base 100. The first resilient contact piece 430 is opposite to the second resilient contact piece 620 so that they can form abutting forces on the earphone plug 30 from opposite sides.

Figure 9:
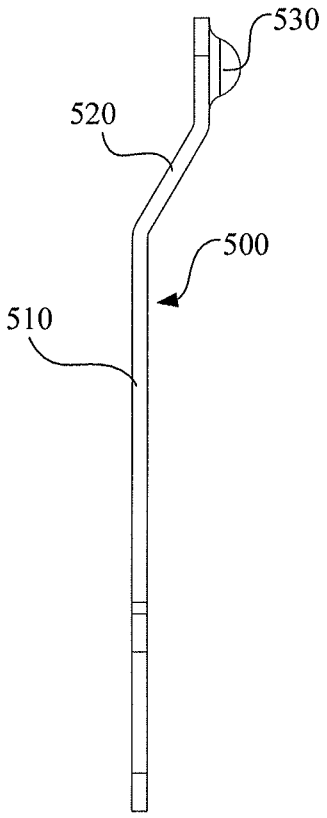
FIG. 9 is a side schematic view of an earthing resilient component shown in FIG. 2.
Figure 10:
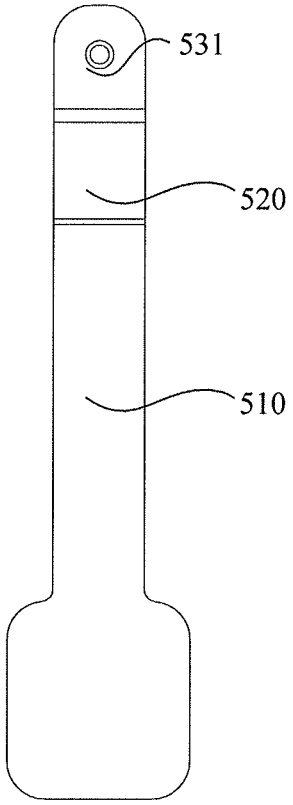
FIG. 10 is a top schematic view of the earthing resilient component shown in FIG. 2.

Referring to FIGS. 2, 9 and 10, in some embodiments, the support base 100 defines a first notch 130, and the first notch 130 runs through first mounting surface 110 and the second mounting surface 120. The first notch 130 corresponds to the microphone resilient component 200. The earthing resilient component 500 includes a fixed part 510, a resilient part 520 and a third protruding part 530. The fixed part 510 is fixedly coupled to the second mounting surface 120. One end of the resilient part 520 is coupled to the fixed part 510, and the resilient part 520 and the fixed part 510 are bent at a certain angle, and the other end of the resilient part 520 is a free end. The resilient part 520 is accommodated in the first notch 130. The third protruding part 530 is located on the resilient part 520, and the third protruding part 530 protrudes beyond the first mounting surface 110 by a set distance. The third protruding part 530 is used to abut against the earphone plug 30, thereby implementing the ground connection of the earphone plug 30. The third protruding part 530 may be tapered, and the third protruding part 530 defines a third through hole 531. The third through hole 531 is used for electrically connecting with an external line.

Referring to FIGS. 13 to 16, the present disclosure further provides a mounting structure 20 which includes the earphone socket 10 and a PCB (printed circuit board) 700. The earphone socket 10 is fixed on the PCB 700. The PCB 700 has a first surface 710 and a second surface 720 opposite to the first surface 710, wherein the first surface 710 is disposed upward, and the second surface 720 is disposed downward. The PCB 700 defines a second notch 730, and the second notch 730 runs through first surface 710 and the second surface 720. The earphone socket 10 is mounted at the second notch 730. In some embodiments and referring to FIGS. 13 and 14, when the earphone socket 10 is mounted on the PCB 700, the first mounting surface 110 of the support base 100 is in close contact with the first surface 710 of the PCB 700, and the functional assembly 201 passes through the second notch 730 toward the second surface 720. In other embodiments and referring to FIGS. 15 and 16, the first mounting surface 110 of the support base 100 is in close contact with the second surface 720 of the PCB 700, and the functional assembly 201 passes through the second notch 730 toward the first surface 710. Therefore, changing the mounting manner of the support base 100 and the PCB 700 can change the distance of the plughole 101 of the earphone socket 10 from the second surface 720. When the mounting structure 20 is used as a part of a mobile terminal, the position of the plughole 101 of the earphone socket 10 relative to the mobile terminal in the thickness direction can also be changed. In some embodiments, the support base 100 is a circuit board, and may be electrically connected to the PCB 700.

The present disclosure further provides a mobile terminal, which can be a mobile phone, a tablet computer or the like. The mobile terminal includes the above-mentioned mounting structure 20. By adopting the mounting structure 20, the overall thickness of the mobile terminal can be reduced, the volume can be reduced, the development requirement of thinning can be satisfied, and at the same time the manufacturing cost of the mobile terminal can be reduced.

It should be understood that, the "terminal" used herein includes, but is not limited to, a device that is configured to receive/transmit communication signals via a wireline connection, such as via a public-switched telephone network (PSTN), digital subscriber line (DSL), digital cable, a direct cable connection, and/or another data connection/network, and/or via a wireless interface with, for example, a cellular network, a wireless local area network (WLAN), a digital television network such as a DVB-H network, a satellite network, an AM-FM broadcast transmitter, and/or another communication terminal. A communication terminal that is set to communicate over a wireless interface may be referred to as a "wireless communication terminal", "wireless terminal" and/or "mobile terminal". Examples of the mobile terminal include, but are not limited to, a satellite or cellular radiotelephone; a Personal Communications System (PCS)

terminal that may combine a cellular radiotelephone with data processing, facsimile and data communications capabilities; a PDA that can include a radiotelephone, pager, Internet/intranet access, Web browser, organizer, calendar and/or a global positioning system (GPS) receiver; and a conventional laptop and/or palmtop receiver or other appliance that includes a radiotelephone transceiver.

The technical features of the above-described embodiments can be arbitrarily combined. In order to make the description brief, not all possible combinations of the respective technical features in the above-described embodiments are described. As long as there is no contradiction in the combination of these technical features, it should be considered within the scope of present disclosure.

The above-described embodiments are merely illustrative of several embodiments of the present disclosure, and the description thereof is specific and detailed. The above embodiments cannot be construed to limit the present disclosure. It should be noted that, a number of variations and modifications may be made by those skilled in the art without departing from the spirit and scope of the disclosure. Therefore, the scope of the present disclosure should be subject to the appended claims.

What is claimed is:

1. An earphone socket configured to mate with an earphone plug, comprising:

a support base;

a functional assembly, comprising:

a microphone resilient component, the microphone resilient component comprising a first arc-shaped sleeve;

a right channel resilient component, the right channel resilient component comprising a second arc-shaped sleeve; and a left channel resilient component, the left channel resilient component comprising a circular sleeve and a first resilient contact piece coupled to the circular sleeve; the microphone resilient component, the right channel resilient component, and the left channel resilient component being fixed on the support base; the first arc-shaped sleeve, the second arc-shaped sleeve, and the circular sleeve being arranged to define a plughole configured to mate with the earphone plug; and the first resilient contact piece being configured to press the earphone plug; and an earthing resilient component, fixed on the support base and configured to abut against the earphone plug;

wherein the support base comprises a first mounting surface and a second mounting surface opposite to the first mounting surface; and wherein the microphone resilient component, the right channel resilient component, and the left channel resilient component are fixed on the first mounting surface, and the earthing resilient component is fixed on the second mounting surface.

2. The earphone socket as described in claim 1, wherein the microphone resilient component further comprises a first assembling part positioned at two ends of the first arc-shaped sleeve and coupled to the support base, the right channel resilient component further comprises a second assembling part positioned at two ends of the second arc-shaped sleeve and coupled to the support base, the left channel resilient component further comprises a third assembling part positioned on the circular sleeve and coupled to the support base, and the first resilient contact piece is coupled to the third assembling part.

3. The earphone socket as described in claim 1, wherein the microphone resilient component is close to one end of the support base, the left channel resilient component is close to the other end of the support base, and the right channel resilient component is located between the microphone resilient component and the left channel resilient component.

4. The earphone socket as described in claim 2, wherein the first arc-shaped sleeve comprises:

a first arc-shaped mating body, configured to mate with and position the earphone plug;

a first arc-shaped resilient piece, wherein a first end of the first arc-shaped resilient piece is coupled to one end of the first arc-shaped mating body, and a second end of the first arc-shaped resilient piece is a free end and faces to the other end of the first arc-shaped mating body; and a first protruding part defining a first through hole, wherein the first protruding part is located on the second end of the first arc-shaped resilient piece, and the first arc-shaped resilient piece and the first protruding part are configured to provide a pressing force to the earphone plug.

5. The earphone socket as described in claim 4, wherein the first assembling part comprises a first inserting piece coupled to the first arc-shaped mating body and a first supporting lug located on an end of the first arc-shaped sleeve and facing to the first inserting piece; and wherein the support base defines a first mounting hole for mating with the first inserting piece and a first recessed groove corresponding to the first supporting lug, and the first supporting lug is fixed in the first recessed groove.

6. The earphone socket as described in claim 4, wherein the first arc-shaped mating body and the first arc-shaped resilient piece are separated by a first gap, the first gap runs through the first arc-shaped sleeve and extends along a circumferential direction of the first arc-shaped sleeve.

7. The earphone socket as described in claim 2, wherein the second arc-shaped sleeve comprises:

a second arc-shaped mating body, configured to mate with and position the earphone plug;

a second arc-shaped resilient piece, wherein a first end of the second arc-shaped resilient piece is coupled to one end of the second arc-shaped mating body, and a second end of the second arc-shaped resilient piece is a free end and faces to the other end of the second arc-shaped mating body; and a second protruding part, defining a second through hole, wherein the second protruding part is located on the second end of the second arc-shaped resilient piece, and the second arc-shaped resilient piece and the second protruding part are configured to provide a pressing force to the earphone plug.

8. The earphone socket as described in claim 7, wherein the second assembling part comprises a second inserting piece coupled to the second arc-shaped mating body and a second supporting lug located on an end of the second arc-shaped sleeve and facing to the second inserting piece; and wherein the support base defines a second mounting hole for mating with the second inserting piece and a second recessed groove corresponding to the second supporting lug, and the second supporting lug is fixed in the second recessed groove.

9. The earphone socket as described in claim 7, wherein the second arc-shaped mating body and the second arc-shaped resilient piece are separated by a second gap, and the second gap runs through the second arc-shaped sleeve and extends along a circumferential direction of the second arc-shaped sleeve.

10. The earphone socket as described in claim 2, wherein the first resilient contact piece comprises a first arc segment coupled to the third assembling part, a first linear segment coupled to the first arc segment, and a first curved segment; one end of the first curved segment is coupled to the first linear segment, the other end of the first curved segment is a free end, and the first curved segment is bent to form a protrusion configured to press the earphone plug.

11. The earphone socket as described in claim 2, wherein the third assembling part comprises two third inserting pieces coupled to the circular sleeve, the third inserting piece comprises a first step surface; and wherein the support base defines a third mounting hole for mating with an end of the third inserting piece, and the first step surface is in close contact with the first mounting surface.

12. The earphone socket as described in claim 2, further comprising a detection resilient component configured to detect the earphone plug, the detection resilient component comprising a fourth inserting piece and a second resilient contact piece;

wherein the second resilient contact piece comprises a second arc segment coupled to the fourth inserting piece, a second linear segment coupled to the second arc segment, and a second curved segment; one end of the second curved segment is coupled to the second linear segment, the other end of the second curved segment is a free end, and the second curved segment is bent to form a protrusion configured to press the earphone plug; and wherein the fourth inserting piece comprises a second step surface, the support base defines a fourth mounting hole for mating with an end of the fourth inserting piece, and the second step surface is in close contact with the first mounting surface.

13. The earphone socket as described in claim 2, wherein the support base defines a first notch corresponding to the microphone resilient component; the earthing resilient component comprises:

a fixed part, fixed on the second mounting surface;

a resilient part, wherein one end of the resilient part is bent from the fixed part, the other end of the resilient part is a free end, and the resilient part is received in the first notch, and a third protruding part, arranged on the resilient part and defining a third through hole, the third protruding part being configured to press the earphone plug.

14. The earphone socket as described in claim 1, wherein a thickness of the support base is 0.6 mm to 2 mm.

15. A mounting structure, comprising a printed circuit board (PCB) and an earphone socket for receiving an earphone plug, wherein the earphone socket comprises:

a support base;

a functional assembly, comprising:

a microphone resilient component, the microphone resilient component comprising a first arc-shaped sleeve;

a right channel resilient component, the right channel resilient component comprising a second arc-shaped sleeve; and a left channel resilient component, the left channel resilient component comprising a circular sleeve and a first resilient contact piece coupled to the circular sleeve; the microphone resilient component, the right channel resilient component, and the left channel resilient component being fixed on the support base; the first arc-shaped sleeve, the second arc-shaped sleeve, and the circular sleeve being arranged to define a plughole configured to mate with the earphone plug; and the first resilient contact piece being configured to press the earphone plug; and an earthing resilient component, fixed on the support base and configured to abut against the earphone plug;

wherein the PCB comprises a first surface and a second surface opposite to the first surface, the PCB defines a second notch which runs through the first surface and the second surface, and the earphone socket is fixed to the PCB so that the earphone socket is partly accommodated in the second notch;

wherein the support base comprises a first mounting surface and a second mounting surface opposite to the first mounting surface; and wherein the microphone resilient component, the right channel resilient component, and the left channel resilient component are fixed on the first mounting surface, and the earthing resilient component is fixed on the second mounting surface.

16. The mounting structure as described in claim 15, wherein the functional assembly passes through the second notch, and the first mounting surface is in close contact with the first surface or the second surface of the PCB;

wherein the microphone resilient component further comprises a first assembling part positioned at two ends of the first arc-shaped sleeve and coupled to the support base, the right channel resilient component further comprises a second assembling part positioned at two ends of the second arc-shaped sleeve and coupled to the support base, the left channel resilient component further comprises a third assembling part positioned on the circular sleeve and coupled to the support base, and the first resilient contact piece is coupled to the third assembling part.

17. The mounting structure as described in claim 16, wherein the first arc-shaped sleeve comprises:

a first arc-shaped mating body configured to mate with and position the earphone plug;

a first arc-shaped resilient piece, wherein a first end of the first arc-shaped resilient piece is coupled to one end of the first arc-shaped mating body, and a second end of the first arc-shaped resilient piece is a free end and faces to the other end of the first arc-shaped mating body; and a first protruding part defining a first through hole, wherein the first protruding part is located on the second end of the first arc-shaped resilient piece, and the first arc-shaped resilient piece and the first protruding part are configured to provide a pressing force to the earphone plug.

18. The earphone socket as described in claim 17, wherein the first assembling part comprises a first inserting piece coupled to the first arc-shaped mating body and a first supporting lug located on an end of the first arc-shaped sleeve and facing to the first inserting piece; and wherein the support base defines a first mounting hole for mating with the first inserting piece and a first recessed groove corresponding to the first supporting lug, and the first supporting lug is fixed in the first recessed groove.

19. The earphone socket as described in claim 17, wherein the first arc-shaped mating body and the first arc-shaped resilient piece are separated by a first gap, the first gap runs through the first arc-shaped sleeve and extends along a circumferential direction of the first arc-shaped sleeve.

20. A mobile terminal, comprising:

a printed circuit board (PCB) and an earphone socket for receiving an earphone plug, wherein the earphone socket comprises:

a support base, comprising a first mounting surface and a second mounting surface opposite to the first mounting surface;

a functional assembly, comprising:

a microphone resilient component, the microphone resilient component comprising a first arc-shaped sleeve and a first assembling part positioned at two ends of the first arc-shaped sleeve and coupled to the support base;

a right channel resilient component, the right channel resilient component comprising a second arc-shaped sleeve and a second assembling part positioned at two ends of the second arc-shaped sleeve and coupled to the support base; and a left channel resilient component, the left channel resilient component comprising a circular sleeve, a third assembling part positioned on the circular sleeve and coupled to the support base, and a first resilient contact piece coupled to the third assembling part; the microphone resilient component, the right channel resilient component and the left channel resilient component being fixed on the first mounting surface; the first arc-shaped sleeve, the second arc-shaped sleeve, and the circular sleeve being arranged to define a plughole configured to mate with an earphone plug; and the first resilient contact piece being configured to press the earphone plug; and an earthing resilient component, fixed on the second mounting surface and configured to abut against the earphone plug;

wherein the PCB comprises a first surface and a second surface opposite to the first surface, the PCB defines a second notch which runs through the first surface and the second surface, and the earphone socket is fixed to the PCB so that the earphone socket is partly accommodated in the second notch;

wherein the support base comprises a first mounting surface and a second mounting surface opposite to the first mounting surface; and wherein the microphone resilient component, the right channel resilient component, and the left channel resilient component are fixed on the first mounting surface, and the earthing resilient component is fixed on the second mounting surface.

* * * * *